US008746687B2

(12) United States Patent
Samoto et al.

(10) Patent No.: US 8,746,687 B2
(45) Date of Patent: Jun. 10, 2014

(54) IMAGE FORMING APPARATUS CAPABLE OF DUPLEX PRINTING

(71) Applicant: Brother Kogyo Kabushiki Kaisha, Nagoya-shi, Aichi-ken (JP)

(72) Inventors: Kenji Samoto, Nagoya (JP); Yuji Koga, Nagoya (JP); Takashi Omura, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/691,237

(22) Filed: Nov. 30, 2012

(65) Prior Publication Data

US 2013/0140764 A1 Jun. 6, 2013

(30) Foreign Application Priority Data

Dec. 2, 2011 (JP) ..... 2011-264184

(51) Int. Cl.
*B65H 29/00* (2006.01)

(52) U.S. Cl.
USPC ..... 271/186; 271/184; 271/225; 399/364; 399/401

(58) Field of Classification Search
USPC ..... 399/110, 124, 364, 401; 271/225, 184, 271/186
See application file for complete search history.

(56) References Cited

U.S. PATENT DOCUMENTS 5,055,885 A * 10/1991 Yoshikado et al. ..... 399/401
5,708,954 A * 1/1998 Ando et al. ..... 399/402
6,185,381 B1 2/2001 Nakahara et al.
6,390,464 B1 * 5/2002 Gutierrez et al. ..... 271/184
8,152,169 B2 * 4/2012 Samoto et al. ..... 271/301
8,172,225 B2 * 5/2012 Tanahashi ..... 271/225
8,419,007 B2 * 4/2013 Iijima ..... 271/3.14
8,494,413 B2 * 7/2013 Ichiki et al. ..... 399/122
8,508,819 B2 * 8/2013 Asada et al. ..... 358/498
8,608,308 B2 * 12/2013 Ito et al. ..... 347/108
2008/0240823 A1 * 10/2008 Asada ..... 399/401
2011/0157664 A1 6/2011 Samoto et al.
2011/0158725 A1 6/2011 Asada et al.
2011/0310207 A1 12/2011 Ito et al.

FOREIGN PATENT DOCUMENTS

JP 2000-238959 A 9/2000
JP 2007-055728 A 3/2007
JP 2011-136827 A 7/2011
JP 2011-136829 A 7/2011
JP 2012-001318 A 1/2012
JP 2012-001328 A 1/2012

* cited by examiner

*Primary Examiner* — Ernesto Suarez
(74) *Attorney, Agent, or Firm* — Merchant & Gould P.C.

(57) ABSTRACT

An image forming apparatus has a rockable member which is configured to rotate about an axis defined at a first end portion among: a first position at which a second end portion at a downstream side in the forward feed direction with respect to the first end portion is supported by the guide member having the first orientation; a second position at which the second end portion is located at a higher position that the second end portion when located at the first position; and a third position at which the second end portion is located at a lower position that the second end portion when located at the first position; and a signal generating unit configured to output a signal corresponding to the position of the rockable member. A photo sensor is provided to generate a signal in accordance with an orientation of the rockable member.

8 Claims, 10 Drawing Sheets

IMAGE FORMING APPARATUS CAPABLE OF DUPLEX PRINTING

CROSS-REFERENCE TO RELATED APPLICATION

This application claims priority under 35 U.S.C. §119 from Japanese Patent Application No. 2011-264184 filed on Dec. 2, 2011. The entire subject matter of the application is incorporated herein by reference.

BACKGROUND

1. Technical Field

The following description relates to an image forming apparatus configured to form images on a printing sheet (hereinafter, simply referred to as a sheet), and in particular, to an image forming apparatus capable of duplex printing (i.e., capable of forming images on both sides of each sheet).

2. Prior Art

Conventionally, an image forming apparatus capable of executing duplex printing has been known. Such an image forming apparatus is typically provided with two sheet feeding paths: a main feeding path (i.e., a forward feeding path); and a re-feeding path (i.e., a reverse feeding path). The main feeding path is a path through which a sheet is fed from a sheet feed tray to a sheet discharge tray via a printing unit configured to form an image on a front surface of the sheet. The re-feeding path is a path through which the sheet, on which an image has been formed by the printing unit and fed on a downstream side of the printing unit, is fed to a position within the main path on an upstream side of the printing unit so that the sheet is fed along the main feeding path again. The sheet, which has been fed through the re-feeding path, is fed again along the main feeding path and reaches the printing unit such that a back surface thereof faces the printing unit. Thus, when the sheet is fed again along the main feeding path, an image is formed on the back surface of the printing sheet.

Generally, an image forming apparatus capable of executing the duplex printing typically requires a greater number of sensors than an image forming apparatus configured to form an image only on one surface of a sheet. For example, the image forming apparatus capable of executing the duplex printing, it is necessary to detect whether the sheet is fed to the re-feeding path, whether the sheet is jammed in the re-feeding path, and the like. As the number of the sensors increase, the image forming apparatus is upsized.

In consideration of the above problem, aspects of the present invention is advantageous that the number of sensors of an image forming apparatus capable of duplex printing is reduced so that the image forming apparatus can be downsized.

According to aspects of the invention, there is provided an image forming apparatus which has a sheet feed unit configured to feed a sheet toward a first feed path in a forward feed direction, a sheet tray configured to accommodate the sheet, the sheet tray being configured to be located at a feedable position at which the sheet feed unit is capable of feeding the sheet accommodated in the sheet tray and a non-feedable position which is different from the feedable position, a recording unit configured to record an image on the sheet which is fed from the sheet tray and guided by the first feed path, a roller provided on a downstream side, in the forward feed direction, with respect to the recording unit, the roller being configured to rotate in a first rotation direction to feed the sheet forwardly and a second rotation direction to feed the sheet reversely, a guide member including a first guide part defining a part of a lower surface of a second feed path which is connected to the first feed path at a first predetermined position which is located on a downstream side, in the forward feed direction, with respect to the recording unit and on an upstream side with respect to the roller, and at a second predetermined position which is located on an upstream side, in the forward feed direction, with respect to the recording unit, the guide member being configured to switch an orientation between a first orientation at which the first guide part define a part of the lower surface of the second feed path and a second orientation at which the first guide part is located at a lower position than a position at the first orientation, an interlocking mechanism which causes the guide member to have the first orientation in association with movement of the sheet tray to the feedable position, the interlocking mechanism causing the guide member to have the second orientation in association with movement of the sheet tray to the non-feedable position, a rockable member located at the first predetermined position, and a signal generating unit configured to output a signal corresponding to the position of the rockable member.

The rockable member is configured to rotate about an axis defined at a first end portion among a first position at which a second end portion at a downstream side in the forward feed direction with respect to the first end portion is supported by the guide member having the first orientation, a second position at which the second end portion is located at a higher position that the second end portion when located at the first position, and a third position at which the second end portion is located at a lower position that the second end portion when located at the first position.

According to the aspects of the present invention, by detecting a position of the rockable unit based on a signal generated by the signal generating unit, not only a position of the rockable unit but a status of a guide member, a position of a sheet tray and a current location of the sheet can be detected. In other words, the sensors used to detect the status of the guide member, the position of the sheet tray and the location of the sheet are commoditized. As a result, the size of the image forming apparatus can be reduced.

BRIEF DESCRIPTION OF THE ACCOMPANYING DRAWINGS

DETAILED DESCRIPTION OF EMBODIMENT

Hereinafter, referring to accompanying drawings, an MFD 10 according to an embodiment of the invention will be described. It should be appreciated that the embodiment described hereinafter is an exemplary embodiment according to the present invention and could be modified in various ways without departing from the scope of the invention. In the following description, an up-and-down direction 7 is defined based on a state where the MFD 10 is placed for use (i.e., a state shown in FIG. 1). Further, a front-and-rear direction 8 is defined as a surface of the MFD 10 formed with an opening 13 is a front surface. A right-and-left direction 9 of the MFD 10 is defined when the MFD 10 is viewed from the front side.

Overall Structure of MFD

Figure 1:
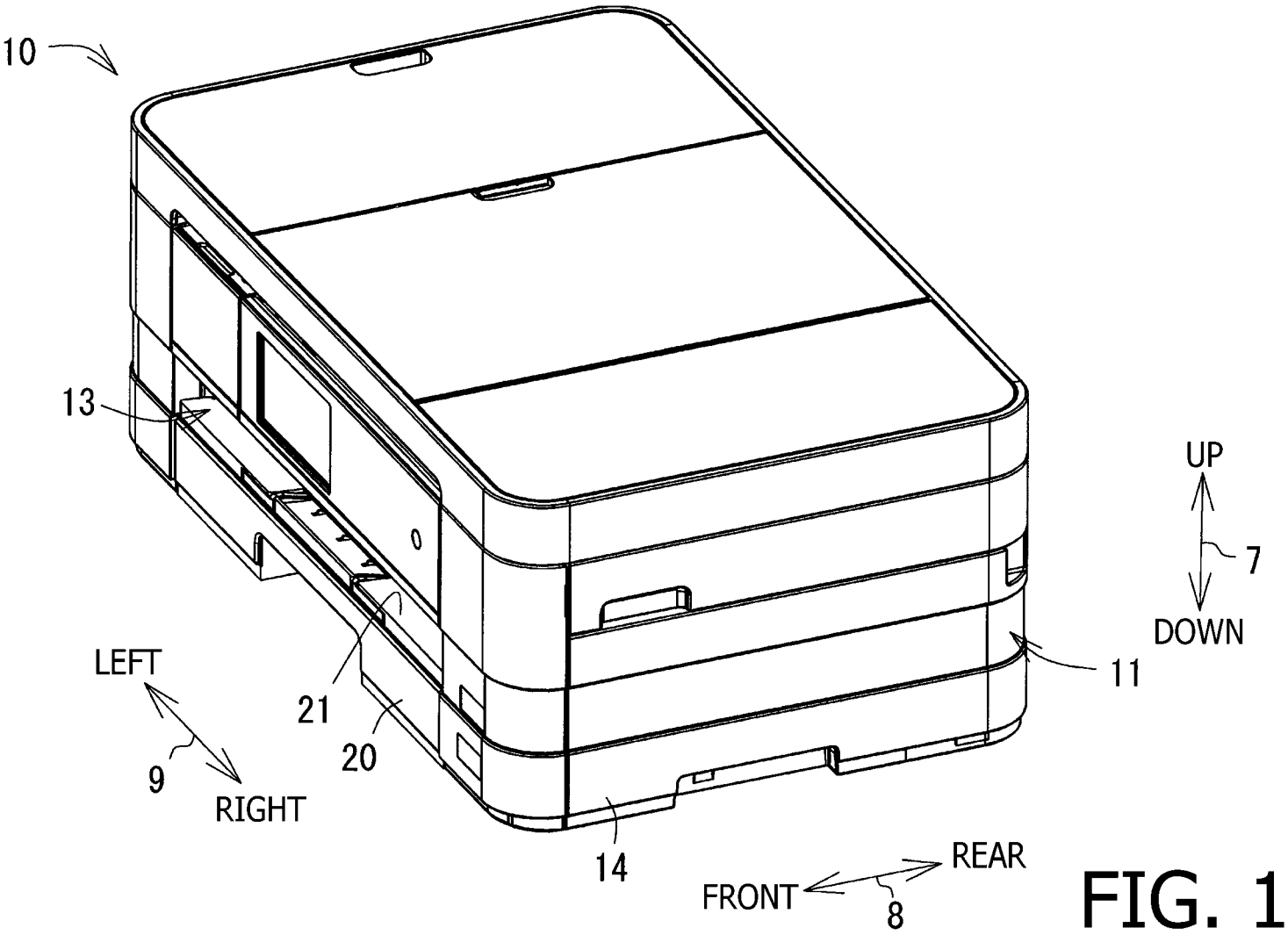
FIG. 1 is a perspective view of an multi-function device (MFD) according to an embodiment of the invention.

The MFD 10 has a substantially rectangular parallelepiped shape as shown in FIG. 1. The MFD 10 is formed with a printing unit 11. The printing unit 11 has a casing 14 which is formed with an opening 13 on a front surface thereof. A sheet feed tray 20 is provided to be removably inserted through the opening 13. The sheet feed tray 20 is configured to accommodate printing sheets (hereinafter, also referred to simply as sheets) 12 of desired sizes (e.g., A4 size: 210 mm×297 mm; B4 size: 257 mm×364 mm).

Figure 2:
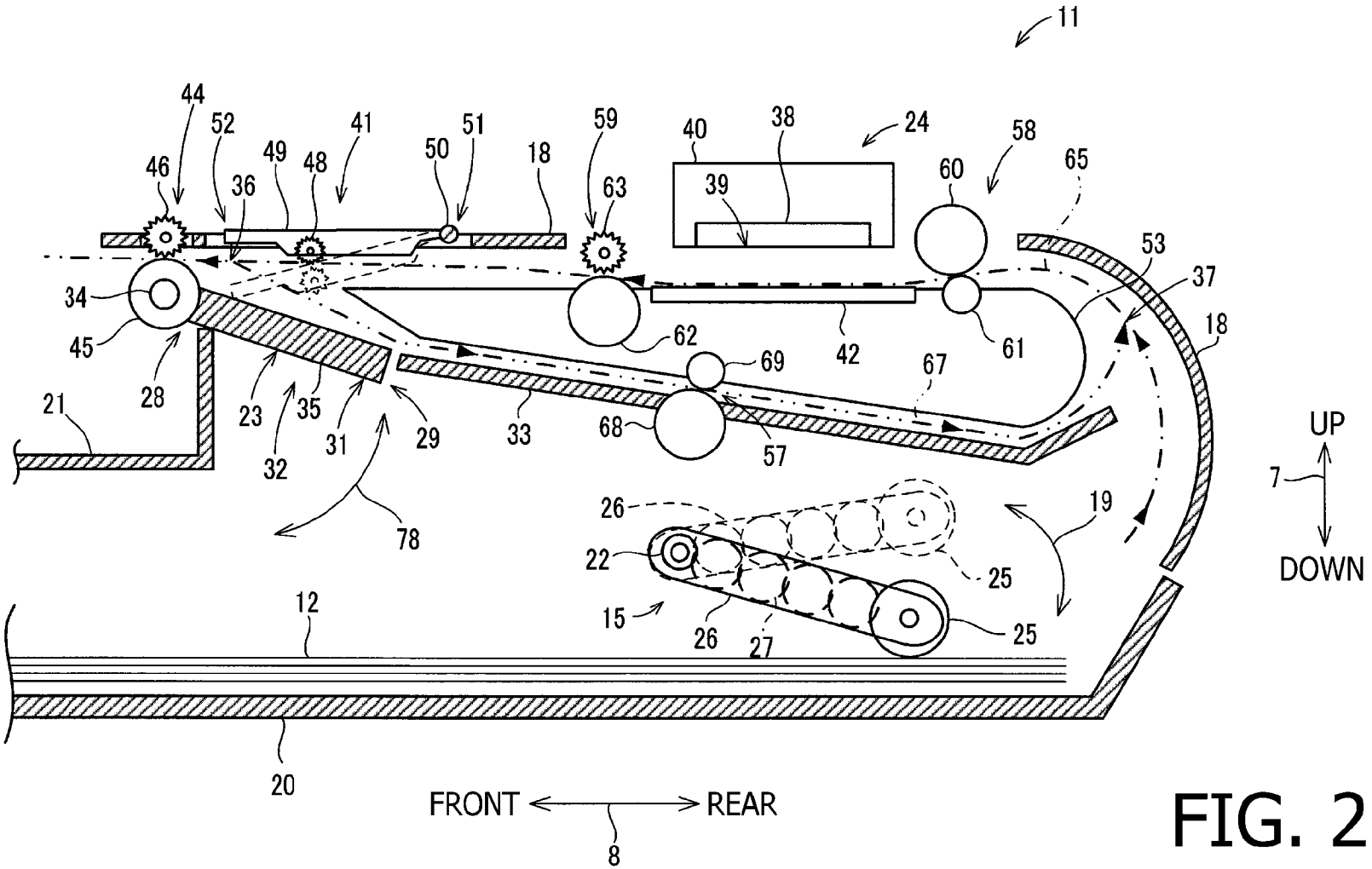
FIG. 2 is across-sectional side view schematically showing a structure of a printing unit of the NM) shown in FIG. 1.

As shown in FIG. 2, the printing unit 11 is provided with a sheet feeding unit 15 configured to feed the sheets 12 accommodated in the sheet feed tray 20, and a recording unit 21 configured to print images on the sheets 12 in accordance with a well-known inkjet printing method.

Sheet Feed Tray

As shown in FIG. 2, the sheet feed tray 20 is located below the recording unit 24 when fully inserted in the printing unit 11. The sheet feed tray 20 is formed to have a box shape without an upper surface. According to the exemplary embodiment, an upper-front side portion of the sheet feed tray 20 is covered with a discharge tray 21 (see FIG. 2).

In the following description, a position of the sheet feed tray 20 when fully inserted in the printing unit 11 will be referred to as a coupled position as shown in FIG. 2. When the sheet feed tray 20 is located at the coupled position, the sheets accommodated in the sheet feed tray 20 can be fed to a main feed path 65. Each sheet 12 fed to the main feed path 65 is fed to the recording unit 24, by which an image is printed on the sheet 12, and discharged onto the discharge tray 21.

The sheet feed tray 20 can be slid in the front-and-rear direction 8 when inserted in or removed from the printing unit 12. When the sheet feed tray 20 is located at an uncoupled position (i.e., when the sheet feed tray 20 is inserted in the printing unit 10 but not fully inserted therein), the sheet feeding unit 15 is unable to feed the sheets 12 accommodated in the sheet feed tray 20 to the main feed paths 65, or even if the sheet feeding unit 15 is capable of moving a sheet 12 accommodated in the sheet feed tray 20, the sheet 12 may not be added to the main feed path 65.

Sheet Feeding Unit

As shown in FIG. 2, the sheet feeding unit 15 is arranged above the sheet feed tray 20. The sheet feeding unit 15 includes a sheet feed roller 25, a sheet feed arm 26, a driving force transmitting mechanism 27 and a shaft 22. The sheet feed roller 25 is secured to the sheet feed arm 26 at a distal end portion thereof. The sheet feed arm 26 is rotatable, in a direction indicated by an arrow 19, about the shaft 22. As the sheet feed arm 26 is rotated, the sheet feed roller 25 moves closer to or farther from the sheet feed tray 20. A driving force of a sheet feed motor (not shown) is transmitted to the sheet feed roller 25 via the driving force transmitting mechanism 27, which is provided with a plurality of gears, so that the sheet feed roller 25 is rotated. Specifically, the sheet feed roller 25 is rotated to feed the sheet accumulated on the sheet feed tray 20 in a forward-feed direction which is indicated by a single-dot chain line in FIG. 2. Thus, the sheet 12 is fed, by the sheet feeding unit 15, toward the sheet feed path 65.

Sheet Feed Path

The main feed path 65 extends, in a curved manner, from a rear end portion of the sheet feed tray 20 toward an upper-front direction, passing below the recording unit 24 and connected to the discharge tray 21 (see FIG. 2). The main feed path 65 is defined by an outer guide member 18 and an inner guide member 53, which are arranged to face each other with a predetermined clearance therebetween. It is noted that each of the outer guide member 18 and the inner guide member 53 extends in a right-and-left direction 9 (i.e., a direction perpendicular to a plane of FIG. 2). So are first and second lower guide members 32 and 33, which will be described later.

Recording Unit

As shown in FIG. 2, the recording unit 24 is provided with a carriage 40 which carries a recording head 38 and is configured to reciprocate in a main scanning direction (i.e., a direction perpendicular to the plane of FIG. 2). To the recording head 38, ink is supplied from an ink cartridge (not shown). While the carriage 40 is being driven to reciprocate in the main scanning direction, the recording head 38 ejects ink through a plurality of nozzles 39 formed on the bottom surface thereof, thereby an image is formed on the sheet 12 that is fed along the feeding path 65 and held on a platen 42 arranged below the main feeding path 65 to face the recording unit 24.

First Pair of Rollers, Second Pair of Rollers and Third Pair of Rollers

On an upstream side, in the forward-feed direction, with respect to the recording unit 24, a first pair of rollers 58 are provided. The first pair of rollers 58 include a first feed roller 60 arranged on an upper side of the main feed path 65, and a first pinch roller 61 arranged on a lower side of the main feed path 65. The first pinch roller 61 is urged by an elastic member such as a spring (not shown) toward the first feed roller 60. The sheet fed to the first pair of rollers 58 is nipped between the first feed roller 60 and the first pinch roller 61, and fed onto the platen 42.

On the downstream side, in the forward-feed direction, of the recording unit 24, a second pair of rollers 59 are provided. The second pair of rollers 59 include a second feed roller 62 arranged on a lower side of the main feed path 65 and a spur roller 63 arranged on an upper side of the main feed path 65. Similarly to the first pinch roller, the spur roller 63 is urged toward the second feed roller 62 by an elastic member such as a spring (not shown). The sheet 12 fed from the first pair of rollers 58 is nipped between the second feed roller 62 and the spur roller 63 and fed to downstream side in the forward-feed direction.

On the downstream side, in the forward-feed direction, of the second pair of rollers 59, third pairs of rollers 44 are provided. Each third pair of rollers 44 include a third feed roller 45, which is arranged below the main feed path 65 and rotatable about the shaft 34, and a spur roller 46 arranged above the main feed path 65 and face the third feed roller 45. Similar to the first pinch roller 61, the spur roller 46 is urged toward the third feed roller 45. The sheet 12 fed from the second pair of rollers 59 is nipped by third pairs of feed rollers 44 and fed toward the discharge tray 21 or the reverse feed path 67.

Each spur roller 46 is rotatably supported by a supporting member 70 (see FIGS. 7A, 7B, 8A and 8B). The supporting member 70 includes a main body portion 72. At a lower part of the main body 72, the plurality of spur rollers 46 are rotatably secured, and a plurality of ribs 71 are formed.

Figure 7A:
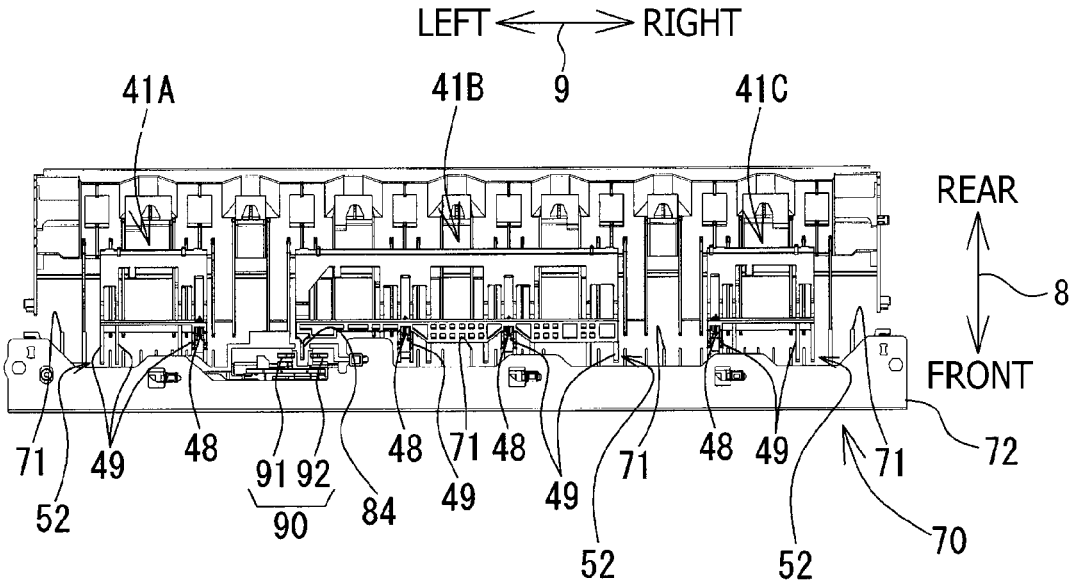
FIG. 7A is a top plan view showing the path switching unit and a supporting member according to the embodiment of the invention.
Figure 7B:
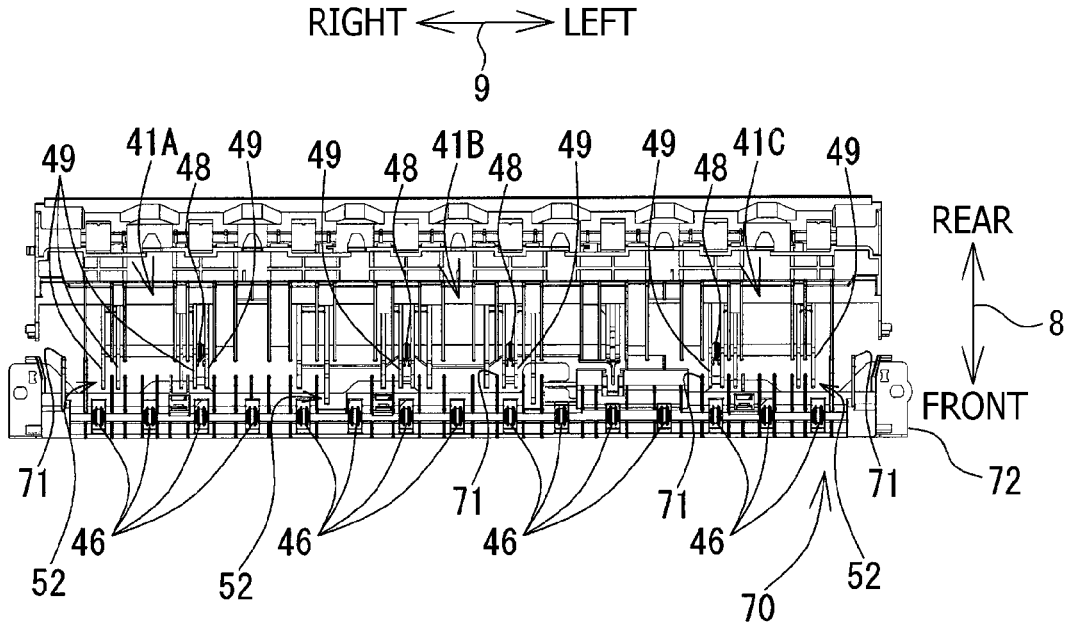
FIG. 7B is a bottom plan view showing the path switching unit and the supporting member according to the embodiment of the invention.
Figure 8A:
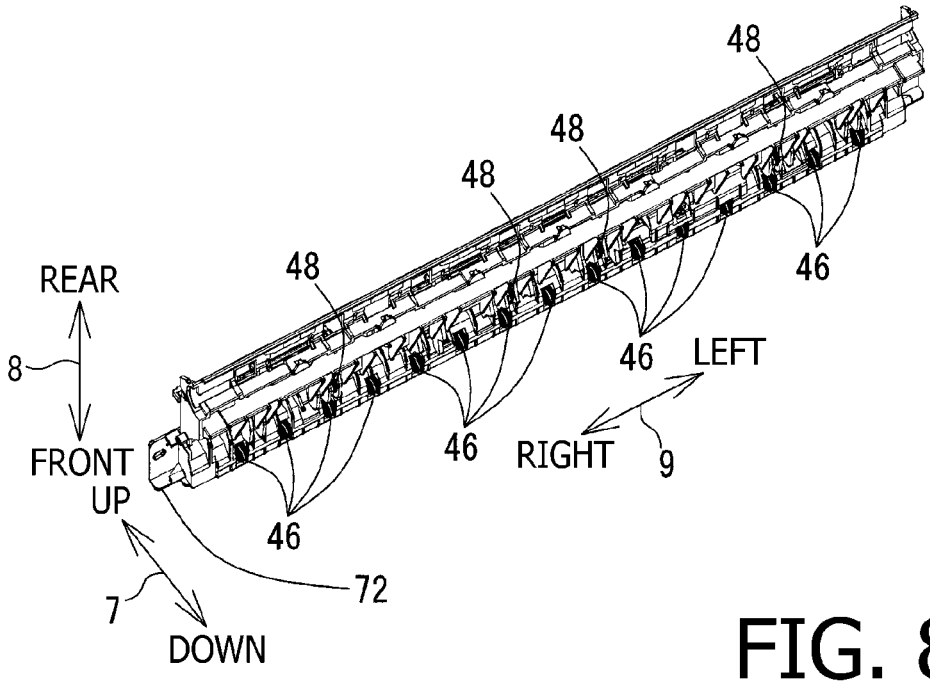
FIG. 8A is a perspective view, viewed from a lower right-rear side, of the path switching unit and the supporting member.
Figure 8B:
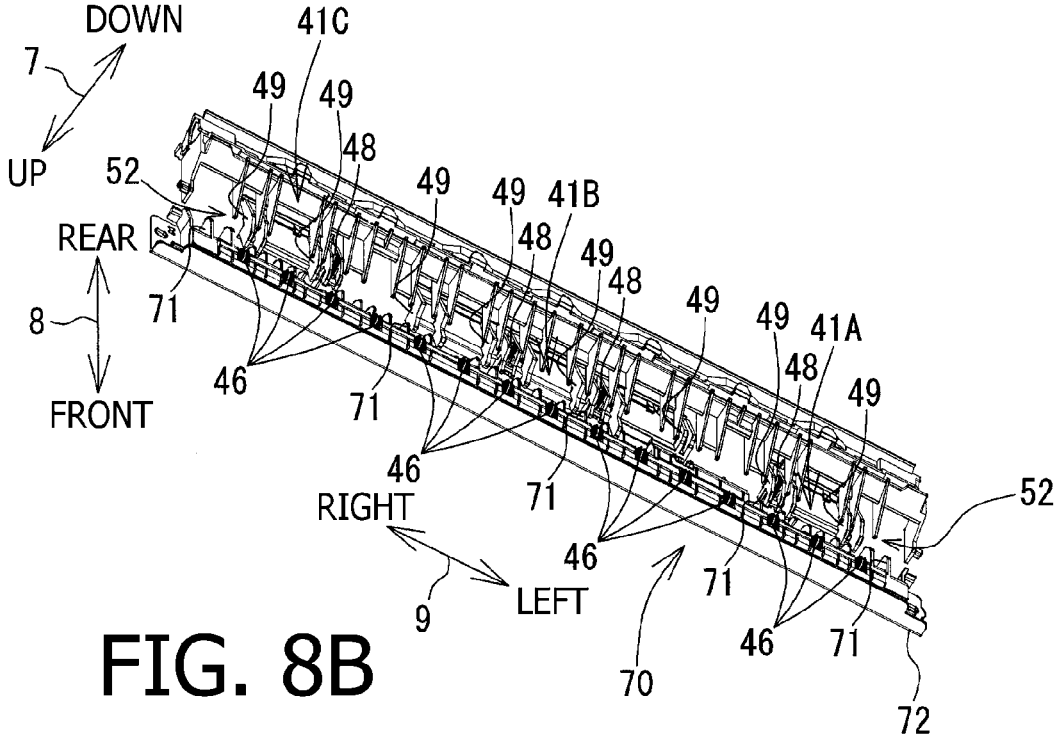
FIG. 8B is a perspective view, viewed from a lower right-front side, of the path switching unit and the supporting member.

The plurality of ribs 71 are arranged separately from each other in the right-and-left direction 9 (see FIGS. 7A and 7B). The ribs 71 extend on the rear side, along the front-and-rear direction 8, with respect to the spur rollers 46. The ribs 71 are provided on the main unit 72 such that a rear end portion of each rib 71 is arranged above the front end portion 52 of a path switching unit 41 and faces the front end portion 52. In other words, each rib 71 is provided to the main unit 72 so as to be protruded toward the path switching unit 41 from the main unit 72.

The first feed roller 60 and the second feed roller 62 (see FIG. 2) rotate forwardly or reversely as a forward or a reverse driving forth is transmitted from a feeding motor (not shown). Specifically, when a forward driving forth is transmitted from the feeding motor, the first feed roller 60 and the second feed roller 62 rotate such that the sheet 12 is fed in the forward feeding direction, while when a reverse driving forth is transmitted from the feeding motor, the first feed roller 60 and the second feed roller 62 rotate such that the sheet 12 is fed in a direction opposite to the forward feeding direction, or in a reverse feeding direction.

The third feed rollers 45 are configured to rotate forwardly or reversely, similarly to the first feed roller 60 and the second feed roller 62, as the forward/reverse driving forth is transmitted from the feeding motor. Specifically, when a single-side printing is executed, the third feed rollers 45 are rotated forwardly. In this case, the sheet 12 is nipped by the third feed rollers 45 and the spur rollers 46 and fed to a downstream side, in the forward feeding direction, and discharged on the discharge tray 21. When the duplex printing is executed, the rotation direction of the third feed rollers 45 is switched from the forward direction to the reverse direction when the third feed rollers 45 and the spur rollers 46 nip the trailing end portion of the sheet 12. When the rotation direction of the third feed rollers 45 are switched, the sheet 12 is fed in a direction opposite to the forward feeding direction (i.e., in the reverse feeding direction), and directed to the reverse feed path 67 by the path switching unit 41.

Reverse Feed Path

The reverse feed path 67 is diverged from the main feed path 65 at a diverging position 36 which is located between the second pair of rollers 59 and the third pair of rollers 44. The reverse feed path 67 extends below the recording unit 24 and above the sheet feed unit 15 so that it converges with the main feed path 65 at a converging position 37 which is located on an upstream side, in the forward feeding direction, with respect to the first pair or rollers 58. Thus, the reverse feed path 67 is connected to the main feed path 65 at the diverging point 36 and the converging point 37, and is formed below the recording unit 24.

The sheet 12 is guided to proceed in a reverse feed direction, which is a direction directed from the diverging position 36 of the converging position 37 indicated by two-dotted line in FIG. 2.

According to the exemplary embodiment, an upper part of the reverse feed path 67 is defined by an inner guide member 53. An upstream side portion, in the reverse feed direction, of a lower part of the reverse feed path 67 is defined by the first lower guide member 32. Further, a downstream side portion, in the reverse feed direction, of the lower part of the reverse feed path 67 is defined by the second lower guide member 33. The inner guide member 53 and the first and second lower guide members 32 and 33 are arranged to face each other with a gap, which the sheet 12 can pass through, therebetween.

First Lower Guide Member

Figure 9:
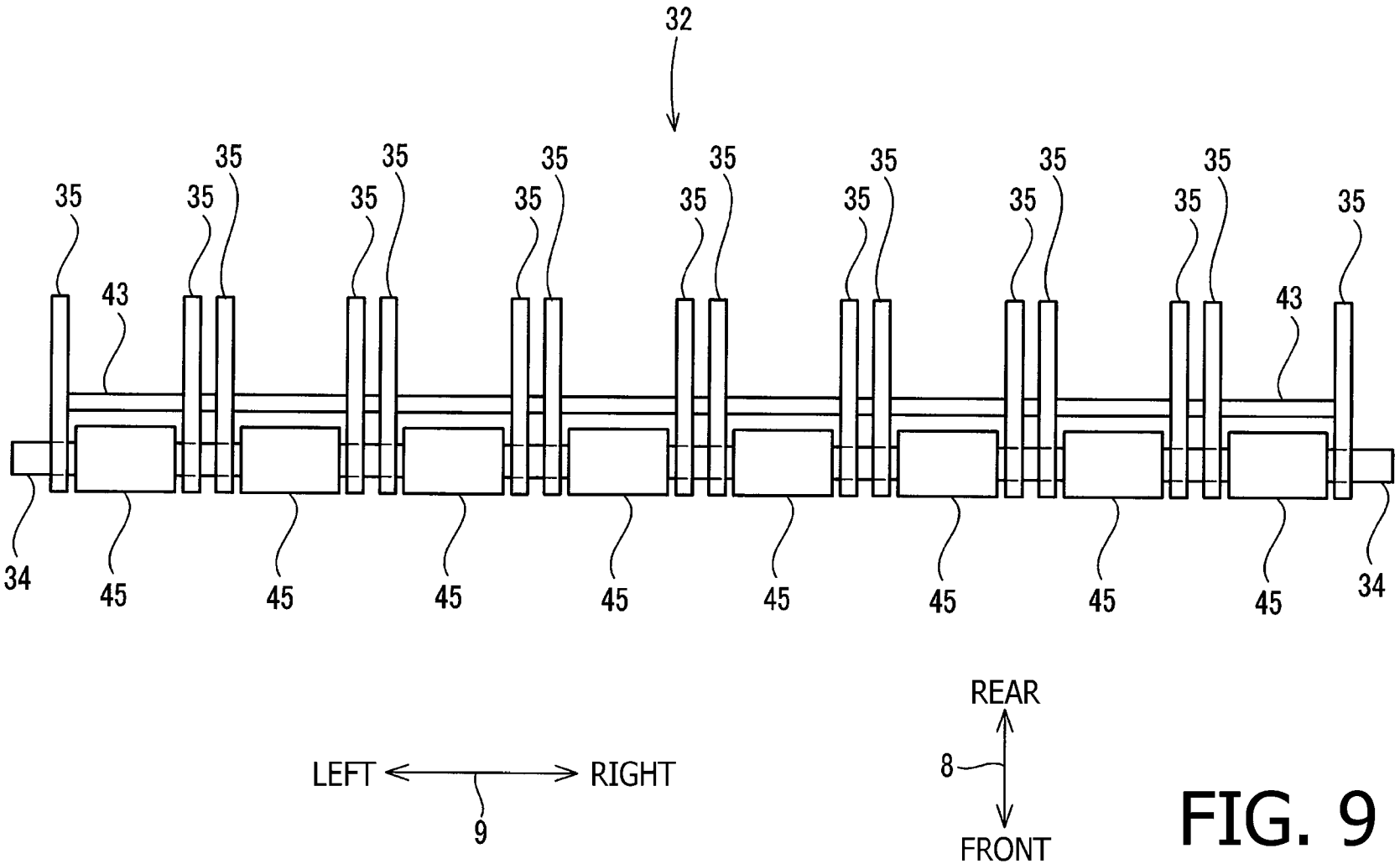
FIG. 9 is a plan view schematically showing a first lower guide unit 32 and third feeding rollers 45.

The first lower guide member 32 includes a plurality of guide members 35 (see FIG. 9) which are arranged in the right-and-left direction 9 with being spaced from each other. The plurality of guide members 35 are rotatably supported by the shaft 34 of the third feed rollers 45 so that the plurality of guide members 35 are idly rotatable about the shaft 34. In other words, the shaft 34 is commonly used by the plurality of guide members 35 and by the plurality of third feed rollers 45, however the plurality of guide members 35 rotate independent of the rotation of the shaft 34. It should be noted that the above configuration is an exemplary one and, in a modification, the first lower guide members 32 and the third feed rollers 45 may be configured to rotate about different shafts.

The plurality of guide members 35 extend obliquely and downwardly from the shaft 34 (see FIGS. 2-6). That is, the plurality of guide members 35 extend along the reverse feed path 67. Specifically, the plurality of guide members 35 extend along the reverse feed path 67, from the front end part 28, which is on the downstream side in the forward feed direction, to the rear end part 39, which is on the second position side. According to the exemplary embodiment, the plurality of guide members 35 may be connected with each other (see FIG. 9) with a connection member 43 extending in the right-and-left direction 9. It is noted that the plurality of guide members 35 may not be connected with each other.

As shown in FIGS. 2-6, upper surfaces of respective guide members 35 form a part of lower part of the reverse feed path 67. The upper surface of each guide member 35 support the sheet 12 guided through the reverse feed path 67 from below.

The first lower guide member 32 is configured to be rotatable, about the shaft 34 of the third feeding rollers 45, in the direction of arrow 78 (see FIG. 2). That is, the rear end portion 29 is rotatable in the direction of arrow 78 about the shaft 34. Specifically, the first lower guide member 32 is rotatable between a first location at which the upper surfaces of the guide members 25 form a part of the lower part of the reverse feed path 67 (see FIGS. 2-5), and a second location which is lower than the first location (see FIG. 6). Thus, the rear end portion 29 when the first lower guide member 32 is located at the second location is lower than the rear end portion 28 when the first lower guide member 32 is located at the first location. Hereinafter, the orientation of the first lower guide member 32 at the first location will be referred to as a first orientation, and the orientation of the first lower guide member 32 at the second location will be referred to as a second orientation.

Figure 6:
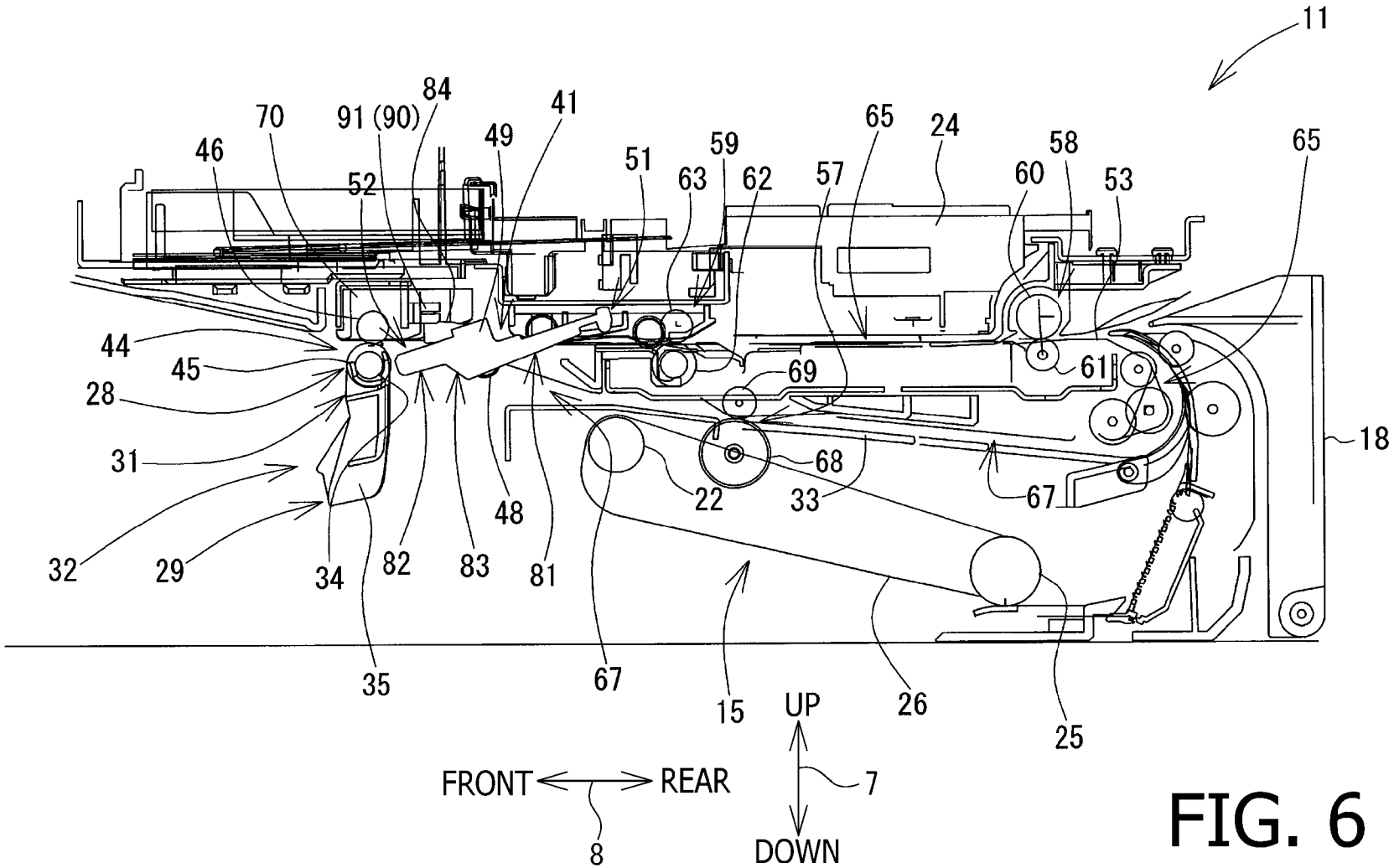
FIG. 6 is a cross-sectional side view of the MFD when a path switching unit 41 is in a third attitude.

According to the exemplary embodiment, the first lower guide member 32 is neutrally located at the second location due to its deadweight unless it is supported from below. That is, as shown in FIG. 6, when the sheet feed tray 20 is removed from the MFP 10, the first lower guide member 32 is located at the second location.

When the first lower guide member 32 is located at the second location (see FIG. 6), and when the sheet feed tray 20 is inserted through the opening 13 and moved rearward, a protruded portion 30 provided to the discharge tray 21 (see FIGS. 3-5) contacts a lower surface 31 of the first lower guide member 32. As the sheet feed tray 20 is further inserted (i.e., moved rearward), the first lower guide member 32 is rotated to move upward as being pushed by the protruded portion 30. Then, as shown in FIGS. 2-5, when the sheet feed tray 20 is completed inserted in the MFP 10 (i.e., located in the coupled position), the first lower guide member 32 is located at the first location as pushed by the protruded portion 30.

As described above, when the sheet feed tray 20 is inserted in the MFP 10, the first lower guide member 32 is supported. That is, the protruded portion 30 moves rearward in association with insertion of the sheet feed tray 20, the first lower guide member 32 is moved to the first location. When the sheet feed tray 20 is moved to be located at the uncoupled position or removed from the MFP 10, support of the first lower guide member 32 by the protruded portion 30 is lost. That is, in association with the movement of the sheet feed tray 20 from the coupled position to the uncoupled position or removal, location of the first lower guide member 32 is changed from the first location to the second location.

According to the exemplary embodiment, the first lower guide member 32 is located at the second location when the sheet feed tray 20 is removed from the MFP 10. Such a configuration could be modified. For example, the first lower guide member 32 may be located to the second location when the sheet feed tray 20 is moved from the completely inserted position but a part of the sheet feed tray 20 still remains in the MFD 10.

In a modification, the protruded portion 30 may be formed on the sheet feed tray 20 instead of the discharge tray 21, in this case, the protruded portion 30 may be formed to extend on the upper surface of the sheet feed tray 20, or the sheet feed tray 20 itself may be formed to have a longer size on the upper side in comparison with the structure shown in FIGS. 3-6. Alternatively, the protruded portion 30 may not be formed on the sheet feed tray 20 or the discharge tray 21, and the first lower guide member 32 may be supported on the upper surface of the sheet feed tray 20 to take the first orientation. In this case, the first lower guide member 32 is formed to have longer size on the downward side in comparison with the structure thereof shown in FIGS. 3-6 so that the first lower guide member 32 is supported by the upper surface of the sheet feed tray 20. When the above modifications are employed, the upper surface of the sheet feed tray 20 serves as a part of the interlocking mechanism.

Alternatively, the first lower guide member 32 may be configured to change its orientation by a movement other than rotation. For example, the first lower guide member 32 may change its orientation as it moves in the up-and-down direction 7.

Fourth Pair of Rollers

As shown in FIG. 2, in the reverse feed path 67, a fourth pair of rollers 57 including a fourth feed roller 68 and the a second pinch roller 69 urged toward each other are provided. The fourth feed roller 68 rotates forwardly/reversely as a forward/reverse driving force of the feed motor (not shown) is transmitted. Specifically, when the forward driving force is transmitted from the feed motor, the fourth feed roller 68 rotates forwardly to feed the sheet 12 in the forward direction, while the reverse driving force is transmitted, the fourth feed roller 68 rotates reversely to feed the sheet 12 in the reverse feed direction.

Feed Path Switching Unit

The printer unit 11 has at least one feed path switching unit 41 which is a rockable unit configured to change its orientation to switch the feed paths of the sheet 12. As shown in FIG. 2, the feed path switching unit 41 is arranged at the diverging position 36. According to the exemplary embodiment, there are three feed path switching units 41A, 41B and 41C are provided, which are arranged in the right-and-left direction with spaced from each other (see FIGS. 7A, 7B, 8A and 8B). It is noted that the number of the feed path switching unit 41 needs not be limited to three, and one or a plurality of number of feed path switching units may be employed.

Each of the path switching units 41A, 41B and 41C includes a shaft 50 (see FIG. 2), guide plates 49 and an auxiliary roller 48 (see FIGS. 2, 7A, 7B, 8A and 8B).

The shaft 50 of each of the path switching units 41A, 41B and 41C extends in the right-and-left direction 9, and rotatably supported to the frame of the printer unit 11. According to the exemplary embodiment, the shafts 50 are rotatably supported by outer guide members 18. Having respective shafts 50, the path switching units 41A, 41B and 41C can be rotated independently.

A plurality of guide plates 49 are provided to each of the path switching units 41A, 41B and 41C. The plurality of guide plates 49 are arranged to be spaced from each other in the right-and-left direction 9. Each guide plate 49 extends in the front-and-rear direction 8, from the shaft 50 to the front end portion 52 in the forward feed direction 52. In other words, the shaft 50 is provided at the rear end portion of the guide plates 49.

The front end portion 52 of each guide plate 49 is located below the support member 70 of the spur roller 46 and face the support member 70 (see FIGS. 3-6). The front end portion 52 of each guide plate 49 protrudes toward the spur roller 46, that is protrude on the front side. Positions of the guide plates 49 in the right-and-left direction 9 are different from those of the ribs 71 of the supporting member 70. Thus, each of the guide plates 49 is capable of moving forward/backward between the ribs 71 in accordance with the orientation of the path switching units 41.

As shown in FIGS. 3-6, a lower surface of each guide plate 49 has a first horizontal surface 82, a second horizontal surface 82 and an inclined surface 83. The first horizontal surface 81 extends in the front-and-rear direction 8. The second horizontal surface 82 is formed on the front side (i.e., on the front end portion 52 side) with respect to the first horizontal surface 81 and on an upper side with respect to the first horizontal surface 81, and extends in the front-and-rear direction 8. The inclined surface 83 is formed such that one end thereof is connected to the first horizontal surface 81 and the other end is connected to the second horizontal surface 82, and extends in an upper oblique direction from the first horizontal surface 81 to the second horizontal surface 82. The first horizontal surface 81, the second horizontal surface 82 and the inclined surface 82 guide the upper surface of the sheet 12 fed through the main feed path 65 and the reverse feed path 67.

On the upper surface of at least one of the guide plate 49, a protruded portion 84 which protrudes upwardly is formed (see FIGS. 3-6). As shown in FIG. 7A, the protruded portion 84 is arranged, in the right-and-left direction 9, between a light emitting section 91 and a light receiving section 92 of a photo sensor 90. Specifically, the protruded portion 84 is configured to be inserted in or retracted from a light path between the light emitting section 91 and the light receiving section 92 depending on the orientation (position) of the path switching unit 41.

As shown in FIGS. 7A, 7B, 8A and 8B, according to the exemplary embodiment, each of the path switching units 41A and 41C, which are arranged at both sides in the right-and-left direction 9, has one auxiliary roller 48, and the switching unit 41B, which is arranged at a center in the right-and-left direction 9, is provided with two auxiliary rollers 48. Each auxiliary roller 48 is rotatably supported by two guide plates 49 at the front end portion of the first horizontal surface 81 of the guide plate 49. A part of the circumferential surface of each auxiliary roller 49 is exposed to a lower side (i.e., the main feed path 65 side) from the first horizontal surface 81. If there are four or more path switching units, at least one auxiliary roller may be provided to each switching unit.

Photo Sensor

The printing unit 11 is provided with the photo sensor 90 (see FIGS. 4, 5, 6 and 7A). As mentioned above, the photo sensor 90 has the light emitting section 91 and the light receiving section 92 which is configured to receive the light emitted by the light emitting section 91.

The light emitting section 91 and the light receiving section 92 are arranged in the right-and-left direction 9 and face each other. As mentioned above, the protruded portion 84 formed to the guide plate 49 is inserted in or retracted from the light path between the light emitting section 91 and the light receiving section 92. According to the exemplary embodiment, the light emitting section 91 is arranged on the left side of the protruded portion 41 and the light receiving section 92 is arranged on the right side of the protruded portion 84. The arrangement of the light emitting section 91 and the light receiving section 92 could be opposite.

As the path switching unit 41 is located at a position where the protruded portion 84 is inserted between the light emitting section 91 and the light receiving section 92, the light emitted by the light emitting section 91 is shielded by the protruded portion 84 and is not received by the light receiving section 92 (when the path switching unit 41 is located at the first or fourth position). In such a state, the photo sensor 90 outputs a low-level signal. When the path switching unit 41 is located at a position where the protruded portion 84 is retracted from the light path between the light emitting section 91 and the light receiving section 92 (when the path switching unit 41 is located at the second or third position), the light emitted by the light emitting section 91 is not blocked by the protruded portion 84 and incident on the light receiving section 92. In such astute, the photo sensor 90 outputs a high-level signal. The high-level signal or the low-level signal output by the photo sensor 90 is transmitted to a control unit (not shown) which controls operation of the MFP 10. As described above, photo sensor 90 outputs the high-level signal or the low-level signal depending on the position of the path switching unit 41.

Movement of Path Switching Unit

The movement of the path switching units 41 will be described. Since all the path switching units 41 move similarly, movement of one path switching unit 41 will be described.

Figure 3:
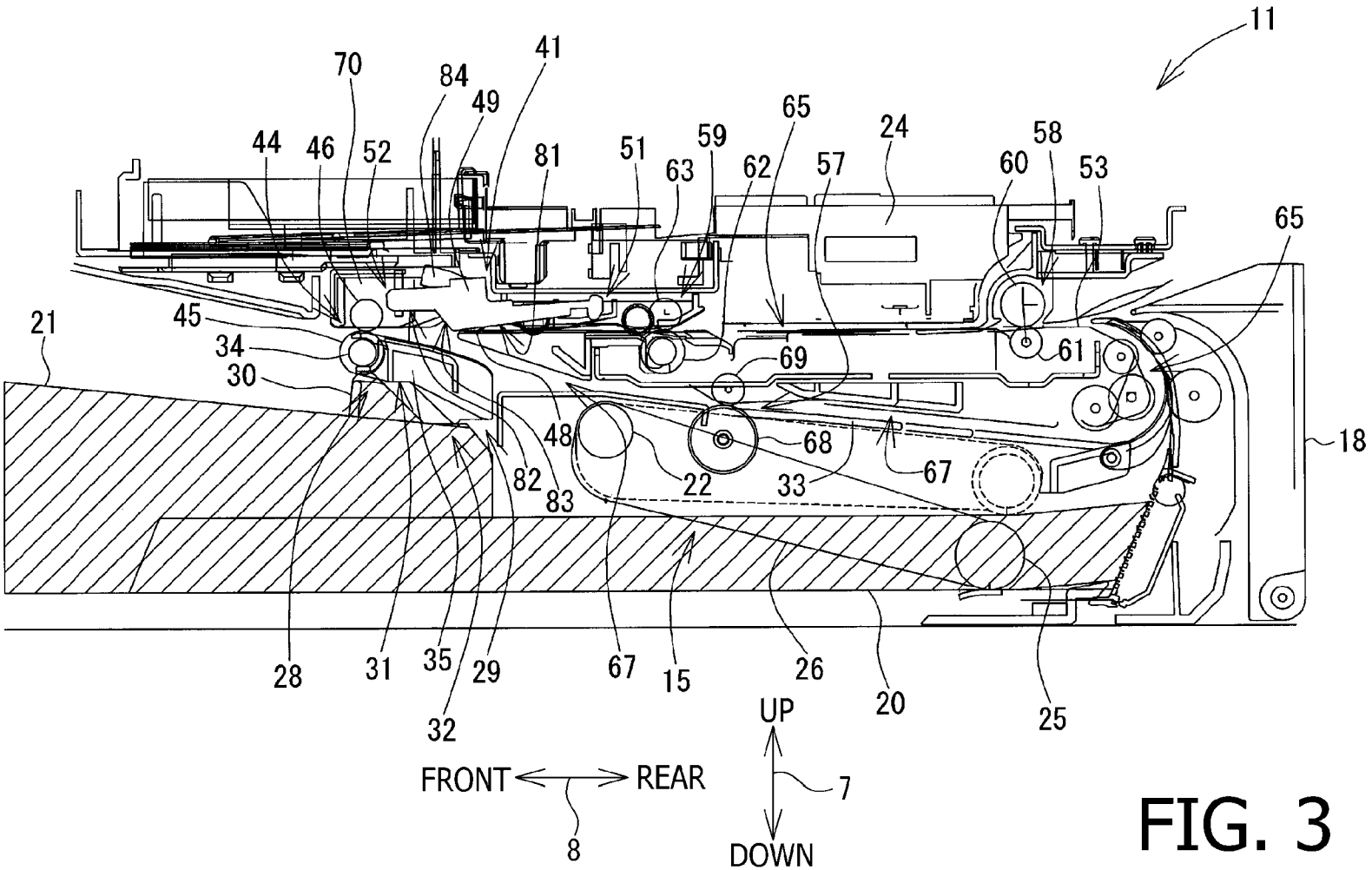
FIG. 3 is a cross-sectional side view of the MFD when a path switching unit 41 is in a second attitude.
Figure 4:
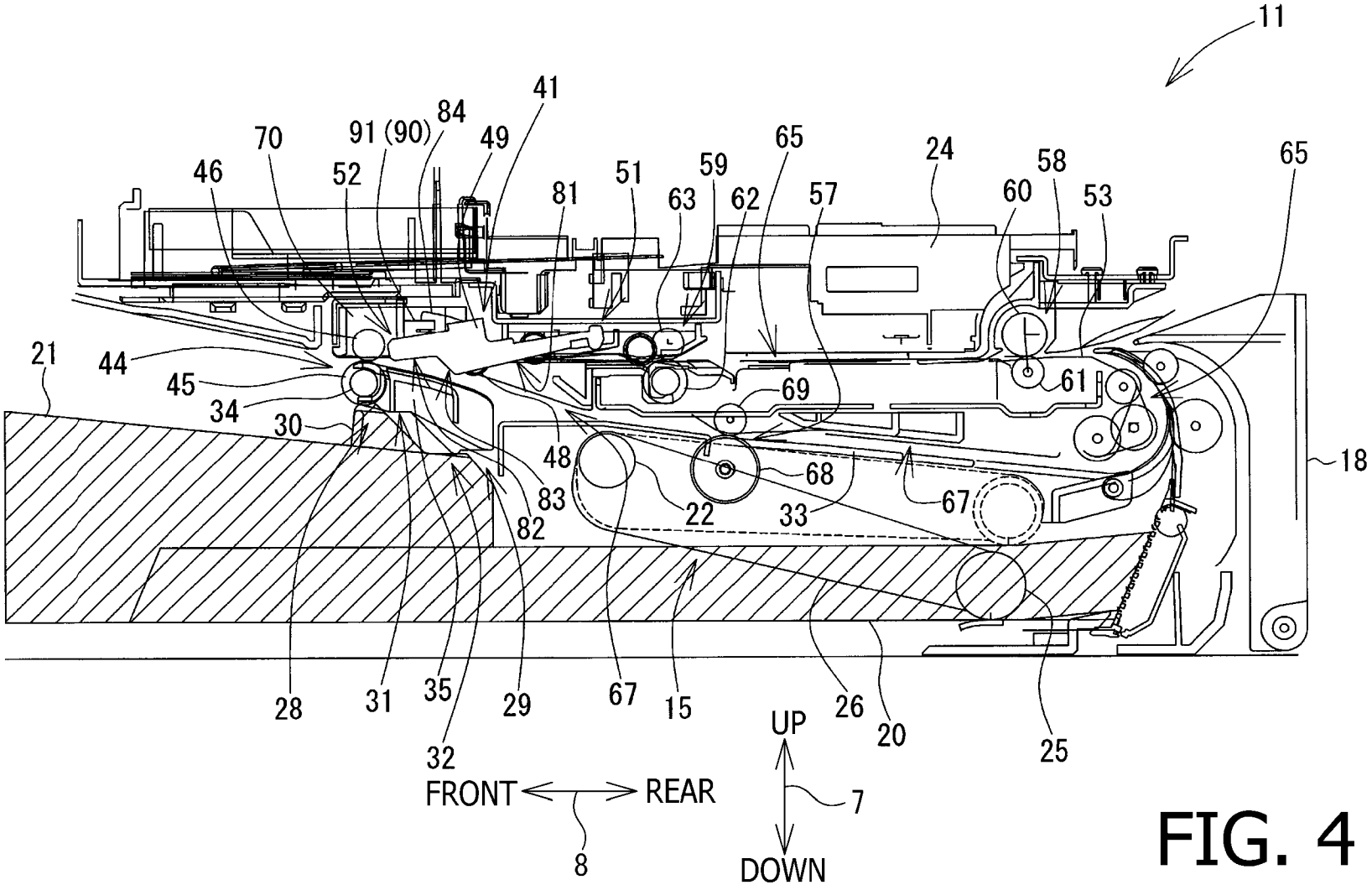
FIG. 4 is a cross-sectional side view of the MID when a path switching unit 41 is in a fourth attitude.

The path switching unit 41 rotates about the shaft 50 (see FIG. 2) such that the path switching unit 41 can be located at the first position (see FIG. 5), the second position (see FIG. 3), the third position (see FIG. 6) and the fourth position (see FIG. 4).

The path switching unit 41 is neutrally located at the first position (see FIG. 5) due to its deadweight when the sheet feed tray 20 is located at the coupled position. At this stage, the second horizontal surface 82 of the guide plate 49 contacts the upper surface of the first lower guide member 32. As mentioned above, the first lower guide member 32 extends in the reverse feed direction from the shaft 34 of the third feed roller 45. In other words, the upper surface of the first lower guide member 32 supports the path switching unit 41 located at the first position on the rear side of the third feed roller 45, or at the upstream side, in the forward feed direction. According to the exemplary embodiment, the first lower guide member 32 contacts the second horizontal surface 83 on the front side with respect to a central position 23 between the front side end 28 and the rear side end 29. In other words, the path switching unit 41 is supported by the first lower guide member 32 at a position on the front side with respect to the central position 23.

When the switching unit 41 is located at the first position (see FIG. 5), the protruded portion 84 is inserted between the light emitting section 91 and the light receiving section 92. Since the light emitted by the light emitting section 91 is blocked by the protruded portion 84, the photo sensor 90 outputs the low-level signal, which is transmitted to the control unit (not shown).

As shown in FIG. 3, when the sheet 12 fed in the main feed path 65 in the forward feeding direction contacts the first horizontal surface 81 of the path switching unit 41 located at the first position, the path switching unit 41 is lifted upward by the sheet 12. Then, the location of the path switching unit 41 is changed from the first position (see FIG. 5) to the second position (see FIG. 3). That is, the path switching unit 41 is located at the second position as the horizontal surface 81 is supported by the sheet 12.

When the path switching unit 41 is located at the second position, the front end portion 52 of the guide plate 49 enters a space between the ribs 71 of the supporting member 70 (see FIGS. 7A, 7B, 8A and 8B). That is, the front end portion 52 of the guide plate 49 is located such that the front end portion 52 is inserted between the ribs of the supporting member 70 when the path switching unit 41 is located at the second position.

When the path switching unit 41 is located at the second position, the protruded portion 84 is located above the light emitting section 91 and the light receiving section 92. That is, at this stage, the protruded portion 84 is retracted from the light path between the light emitting section 91 and the light receiving section 92. Since, the light emitted by the light emitting section 91 is received by the light receiving section 92, the photo sensor 90 outputs the high-level signal, which is transmitted to the control unit.

When the trailing end of the sheet 12, which is fed in the forward feed direction through the main feed path 65, passes the first horizontal surface 81, the path switching unit 41 rotates downward. With this movement, the location of the path switching unit 41 is changed from the second position to the fourth position (see FIG. 4). When the path switching unit 41 is located at the fourth position, the trailing end of the sheet 12, which is being fed forward, contacts the second horizontal surface 82 of the path switching unit 41. In other words, when the path switching unit 41 is located at the fourth position, the second horizontal surface 82 is supported by the sheet 12 which is being fed through the main feed path 65.

Similar to a case where the path switching unit 41 is located at the second position, when the path switching unit 41 is located at the fourth position, the front end portion 52 of the guide plate 49 is inserted between the ribs 71 of the supporting member 70. That is, the front end portion 52 of the guide plate 49 is formed to be located between the ribs 71 when the path switching unit 41 is located at the fourth position.

Similar to a case where the path switching unit 41 is located at the first position, when the path switching unit 41 is located at the fourth position, the protruded portion 84 is located between the light emitting section 91 and the light receiving section 92. At this state, the light emitted by the light emitting section 91 is blocked by the protruded portion 84 and does not reach the light receiving section 92. Therefore, the photo sensor 90 outputs the low-level signal, which is transmitted to the control unit.

When the path switching unit 41 is located at the fourth position, if the third feed roller 45 is rotated forwardly, the sheet 12 is discharged to the discharge tray 12. If the third feed roller 45 is rotated reversely when the path switching unit 41 is located at the fourth position, the sheet 12 is fed to the reverse feed path 67. That is, when the path switching unit 41 is located at the fourth position, if the third feed roller 45 is reversely rotated, a so-called switch-back feed of the sheet 12 is executed. When the switch-back feed is executed, the sheet 12 is fed along the inclined surface 83, thereby the sheet 12 being fed from the main feed path 65 to the reverse feed path 67 smoothly.

Figure 5:
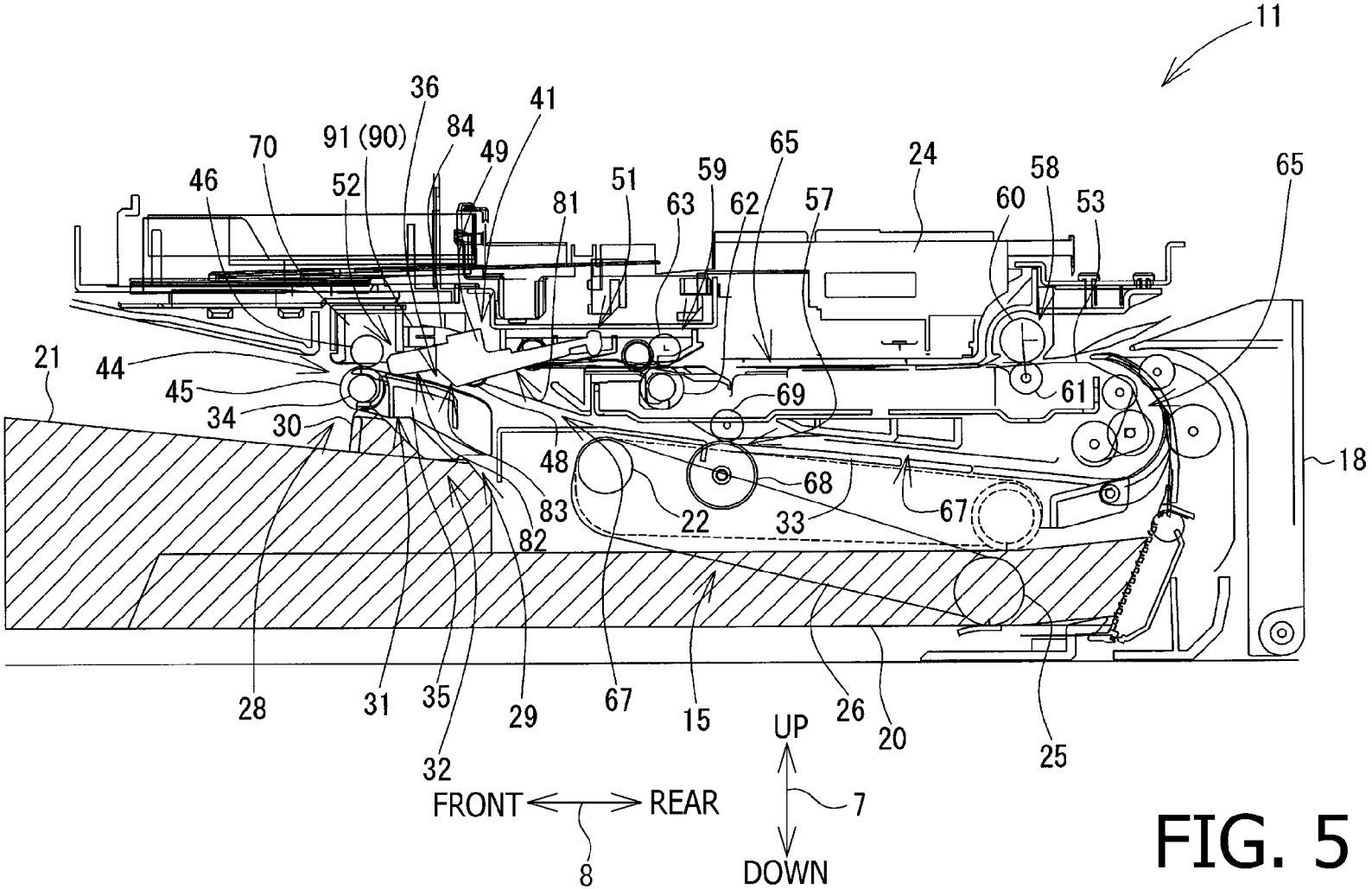
FIG. 5 is a cross-sectional side view of the MFD when a path switching unit 41 is in a first attitude.

When the trading end of the sheet 12 that is fed through the reverse feed path 67 passes the path switching unit 41, or when the trailing end of the sheet 12 fed through the main feed path 65 passes the path switching unit 41, the path switching unit 41 which is not supported by the sheet 12 any more rotates downward. Then, as shown in FIG. 5, the second horizontal surface 82 of the path switching unit 41 contacts the first lower guide member 32 and the path switching unit 41 is located at the first position. At this stage, as mentioned above, the protruded portion 84 is located between the light emitting section 91 and the light receiving section 92.

When the path switching unit 41 is in its first position, if the sheet feed tray 20 is moved from the fully inserted position to the retracted position, the first lower guide member 32 changes its orientation from the first orientation to the second orientation. At this stage, the first lower guide member 32 is not supported by the protruded portion 30 any more, and the path switching unit 41 is not supported by the first lower guide member 32. AS a result, as shown in FIG. 6, the path switching unit 41 rotates downward and changes its position to the third position. According the exemplary embodiment, the path switching unit 41 contacts a stopper (not shown) and stops at the position shown in FIG. 6.

When the path switching unit 41 is located at the third position, the protruded portion 84 is located at a position below the light emitting unit 91 and the light receiving unit 92. That is, at this stage, the protruded portion 84 is retracted from the position between the light emitting unit 91 and light receiving unit 92. Therefore, at this stage, the light emitting part 91 and the light receiving part 92. Then, the photo sensor 90 outputs the high-level signal, which is transmitted to the controller.

According the above-described exemplary embodiment, when the sheet feed tray 20 is located at the coupled position, the first lower guide member 32 is lifted to the first location by the protruded portion 30. At this stage, the path switching unit 41 is located at the first position. That is, when the path switching unit 41 is located at the first position, the first lower guide member 32 is in its first orientation, and the sheet feed tray 20 is located at the fully-inserted position. At this stage, the photo sensor 90 outputs a low level signal.

When the sheet feed tray 20 is moved to the uncoupled position, the first lower guide member 32 is not supported by the protruded part 30 any more, and is located to have the second orientation (i.e., located at the second location). The path switching unit 41 is not supported by the first lower guide member 32, and is moved from the first position to the third position by its deadweight. Thus, when the path switching unit 41 is located at the third position, the first lower guide member 32 has the second orientation, and the sheet feed tray 20 is located at the uncoupled position. At this stage, the photo sensor 90 outputs the high level signal.

When the sheet 12, which is fed in the main feed path 65 in the forward feeding direction, reaches the path switching unit 41, the sheet 12 pushes the path switching unit 41 from below. Then, the path switching unit 41 is supported by the sheet 12 and located at the second position. At this stage, the photo sensor 90 outputs the high-level signal.

Thereafter, when the sheet 12 has passed that first horizontal surface 81 of the path switching unit 41, the path switching unit 41 is located at the fourth position. At this stage, the photo sensor 90 outputs the low-level signal. Further, if the rotation direction of the third feed roller 45 is changed from the forward direction to the reverse direction, the sheet 12 is fed in the reverse direction which is opposite to the forward feed direction. As a result, the sheet 12 is directed to the reverse feed path 67.

As described above, based on the signal output by the photo sensor 90, it is possible to judge whether the path switching unit 41 is located at the first position or the second position. When the position of the path switching unit 41 judged, it is further possible to identify current location of the sheet 12. That is, according to the above-described configuration, it is possible to use the same sensor as ones for the first outer guide member 32 and the sheet feed tray 20. Since the number of sensors is reduced, the MFP 10 can be downsized.

A positional error (positional deviation), when the first lower guide member 32 rotates, is small at the end portion 28 which is close to the shaft 34 than the end portion 29 which is farther from the shaft 34 than the end portion 28. If the positional deviation of the first lower guide member 32 is relatively large, the photo sensor 90 may output incorrect signal. However, according to the exemplary embodiment, the path switching unit 41 is supported by the first lower guide member 32 at a position closer to the end portion 28 than the end portion 29. Therefore, according to the exemplary embodiment, possibility of outputting the above incorrect signal can be suppressed.

According to the exemplary embodiment, since the photo sensor 90 is employed, the path switching unit 41 can change its orientation without contacting the photo sensor 90. Thus, according to the exemplary embodiment, it is possible to avoid a problem that the path switching unit 41 has a difficulty in changing its orientation as load is applied by the sensor.

According to the exemplary embodiment, when the path switching unit 41 is located at the second position, the first horizontal surface 81 is supported by the sheet 12. When the sheet 12 has passed the first horizontal surface 81, the second horizontal surface 82 is supported by the sheet 12. At this stage, the location of the path switching unit 41 is changed from the second position to the fourth position. When the path switching unit 41 is located at the fourth position, the front end portion 52 is lower than a case where the path switching unit 41 is located at the second position. Thus, when the path switching unit 41 is located at the fourth position, the trailing end, in the forward feed direction, of the sheet 12 is pointed to the reverse feed path 67 formed below the main feed path 65. In this state, when the third feed roller 45 feeds the sheet 12 in the reverse direction, the sheet 12 is introduced to the reverse feed path 67. Therefore, according to the exemplary embodiment, it is possible to direct the sheet 12 toward the reverse feed path 67 before the sheet 12 has completely passed the path switching unit 41. As a result, it is possible to shorten the length, in the forward feed direction, of the path switching unit 41, and the MFP 10 can be downsized.

According to the exemplary embodiment, the path switching unit 41 is formed with the inclined and slightly curved inclined surface 82 is formed between the first horizontal surface 81 and the second horizontal surface 82. The sheet 12 directed to the reverse feed path 67 by the third feed roller 45 is guided by the inclined surface 83. Therefore, the sheet 12 is smoothly introduced to the reverse feed path 67.

If only one path switching unit 41 is provided in the right-and-left direction and if the path switching unit 41 is formed to be thin in order to downsize the MFP 10, large warpage of the path switching unit 41 may occur. In such a case, in order to have the photo sensor 90 output the signal accurately represent the positions of the path switching unit 41, it becomes necessary to widen a rotating range of the path switching unit 41 for each orientation thereof. That is, it becomes necessary to rotate the path switching unit 41 by relatively lame amount. However, such a configuration results in upsizing of the MFP 10. Therefore, according to the exemplary embodiment, there are a plurality of path switching units 41 in the right-and-left direction. According to the exemplary embodiment, it is therefore possible to reduce possibility of occurrence of the large warpage even if the path switching units 41 are formed to be thin.

According to the exemplary embodiment, only the path switching units that contact the sheet 12 change the positions. In other words, whether each of the path switching units 41 changes the position is determined based on the size of the sheet 12, in the right-and-left direction, fed in the main feed path 65. That is, the number of the path switching units 45 that change the positions is smaller when the size of the sheet 12 in the right-and-left direction is smaller. Therefore, according to the exemplary embodiment, when the size of the sheet 12 is smaller, load applied to the sheet 12 by the path switching units 41 can be made smaller.

According to the exemplary embodiment, the first lower guide members 32 and the third feed rollers 45 use the same shaft 34. Therefore, the number of shafts used in the MFP 10 can be reduced, which contributes to downsizing of the MFP 10.

According to the exemplary embodiment, when the path switching unit 41 is located at the second position (and also the fourth position), the front end portion 52 of the guide plate 49 enters a space formed between the ribs 71 provided to the supporting member 70. That is, a space for allowing the path switching unit 41 to be located at least at the second position and a space for the supporting member 70 can be commoditized, which contributes to downsizing of the MFP 10.

Modification of Embodiment

According to the exemplary embodiment, the guide plate 49 of the path switching unit 41 has the first horizontal surface 81 and the second horizontal surface 82. When the path switching unit 41 is located at the second position, the first horizontal surface 81 is supported by the sheet 12, and when the path switching unit 41 is located at the fourth position, the second horizontal surface 82 is supported by the sheet 12.

However, the shape of the guide plate 49 of the path switching unit 41 needs not be limited to the above shape. For example, as shown in FIG. 10, the guide plate 49 of the path switching unit 31 may be configured to have only the first horizontal surface 81.

Figure 10:
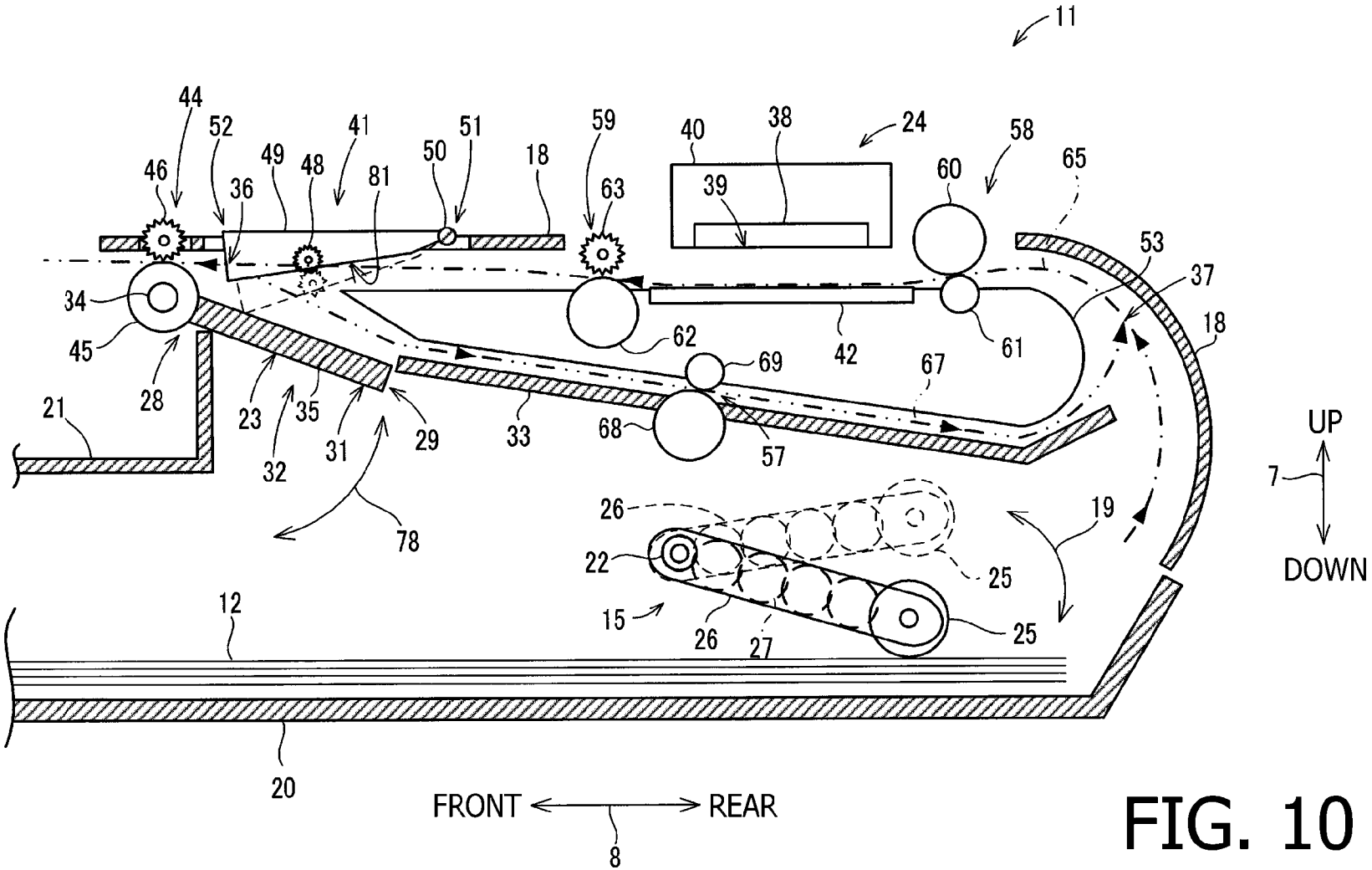
FIG. 10 is a cross-sectional side view schematically showing a structure of a modified printing unit according to a modified embodiment of the invention.

When formed as shown in FIG. 10, the path switching unit 41 is not located at the fourth position. According to this modification, the trailing end portion of the sheet 12 is pointed to the reverse feed path 67 as follows. When the trailing end of the sheet 12 which is being fed forwardly has reached a predetermined position that is on the upstream side with respect to the front end portion 52 and close thereto, downward force by the deadweight of the path switching unit 41 becomes larger than the upward force by the sheet 12 supporting the path switching unit 41. As a result, the path switching unit 41 located at the second position is moved to the first position.

According to the modification, when the sheet 12 has almost passed the path switching unit 41, specifically, when the trailing end of the sheet 12 is located below the path switching unit 41, the deadweight of the path switching unit 41 is larger than the upward forth applied by the sheet 12. At this stage, the path switching unit 41 is moved to the first location. When the path switching unit 41 is located at the first location, if the rotation direction of the third feed roller 45 is changed from the forward direction to the reverse direction, the sheet 12 is fed reversely and introduced to the reverse feed path 67.

What is claimed is:

1. An image forming apparatus, comprising:

a sheet feed unit configured to feed a sheet toward a first feed path in a forward feed direction;

a sheet tray configured to accommodate the sheet, the sheet tray being configured to be located at a feedable position at which the sheet feed unit is capable of feeding the sheet accommodated in the sheet tray and a non-feedable position which is different from the feedable position;

a recording unit configured to record an image on the sheet which is fed from the sheet tray and guided by the first feed path;

a roller provided on a downstream side, in the forward feed direction, with respect to the recording unit, the roller being configured to rotate in a first rotation direction to feed the sheet forwardly and a second rotation direction to feed the sheet reversely;

a guide member including a first guide part defining a part of a lower surface of a second feed path which is connected to the first feed path at a first predetermined position which is located on a downstream side, in the forward feed direction, with respect to the recording unit and on an upstream side with respect to the roller, and at a second predetermined position which is located on an upstream side, in the forward feed direction, with respect to the recording unit, the guide member being configured to switch an orientation between a first orientation at which the first guide part define a part of the lower surface of the second feed path and a second orientation at which the first guide part is located at a lower position than a position at the first orientation;

an interlocking mechanism which causes the guide member to have the first orientation in association with movement of the sheet tray to the feedable position, the interlocking mechanism causing the guide member to have the second orientation in association with movement of the sheet tray to the non-feedable position;

a rockable member located at the first predetermined position, the rockable member being configured to rotate about an axis defined at a first end portion among:

a first position at which a second end portion at a downstream side in the forward feed direction with respect to the first end portion is supported by the guide member having the first orientation;

a second position at which the second end portion is located at a higher position that the second end portion when located at the first position; and a third position at which the second end portion is located at a lower position that the second end portion when located at the first position; and a signal generating unit configured to output a signal corresponding to the position of the rockable member.

2. The image forming apparatus according to claim 1, wherein the guide member supports the rockable member in its first position on the upstream side in the forward feed direction with respect to the roller, wherein the rockable member is formed with:

a second guide portion that guides an upper surface side of the sheet;

a third guide portion that guides the upper surface side of the sheet at an area on a second end portion side with respect to the second guide portion and on an upper side with respect to the second guide portion; and a fourth guide portion extending between the second guide portion and the third guide portion, an end of the fourth guide portion being connected to the second guide portion and the other end of the fourth guide portion being connected to the third guide portion, wherein the second guide portion is supported by the sheet fed in the first feed path when the rockable member is located at the second position, and wherein the rockable member is movable to be located at a fourth position at which:

the second end portion is located on an upper side with respect to a position of the second end portion when the rockable member is located at the first position;

the second end portion is located on a lower side with respect to a position of the second end portion when the rockable member is located at the second position; and the third guide portion is supported by the sheet fed in the first feed path.

3. The image forming apparatus according to claim 2, wherein the signal generating unit includes a light emitting unit and a light receiving unit configured to receive light emitted by the light emitting unit, wherein the rockable member is formed with a light blocking part which is inserted in and retracted from a light path of the light emitted from the light emitting unit to the light receiving unit, and wherein the light blocking part is inserted in the light path when the rockable member is located at the first position and the fourth position, while the light blocking part is retracted from the light path when the rockable member is located at the second position and the third position.

4. The image forming apparatus according to claim 1, wherein the guide member extends, along the second feed path, from a third end portion which is a downstream side end portion in the forward feed direction, with respect to the recording unit, towards a fourth end portion which is a second predetermined position side with respect to the third end portion, the guide member being configured to rotate about a second axis defined at a third end portion side with respect to a central position between the third end portion and the fourth end portion, and wherein the rockable member located at the first position is supported by the guide member at a position on the third end portion side.

5. The image forming apparatus according to claim 1, wherein the signal generating unit comprises a light emitting unit and a light receiving unit configured to receive light emitted by the light emitting unit, wherein the rockable member is formed with a light blocking part which is inserted in and retracted from a light path of the light emitted from the light emitting unit to the light receiving unit, and wherein the light blocking part is inserted in the light path when the rockable member is located at the first position, while the light blocking part is retracted from the light path when the rockable member is located at the second position and the third position.

6. The image forming apparatus according to claim 1, comprising a plurality of the rockable members which are arranged in a second direction that is perpendicular to the first direction, the plurality of the rockable members being configured to be rotatable individually.

7. The image forming apparatus according to claim 1, wherein the guide member extends along the second feed path from a third end portion at a downstream side of the recording unit in the forward feed direction toward a fourth end portion, the guide member being configured to change an orientation as the guide member rotates about a second rotation axis which is located on a third end portion side with respect to a central position between the third end portion and the fourth end portion, and wherein the roller rotates about the second rotation axis.

8. The image forming apparatus according to claim 1, further comprising:

a spur roller arranged above the roller to face the roller, the sheet being nipped between the roller and the spur roller; and a supporting member configured to rotatably support the spur roller, the supporting member facing the second end portion of the rockable member, the supporting member having a plurality of first ribs which are protruded toward the second end portion and extend in the forward feed direction, the plurality of first ribs being arranged in a second direction perpendicular to the forward feed direction, wherein the rockable member is provided with a plurality of second ribs arranged in the second direction, the plurality of second ribs protruding toward the spur roller at the second end portion, and wherein the plurality of second ribs are arranged at positions which enter in spaces formed among the plurality of first ribs when the rockable member is located at the second position.

* * * * *